United States Patent [19]

Markve

[11] 4,185,327

[45] Jan. 29, 1980

[54] VENTILATING AND INSULATING GARMENT

[76] Inventor: Howard J. Markve, Box 344, Silverton, Id. 83867

[21] Appl. No.: 925,272

[22] Filed: Jul. 17, 1978

[51] Int. Cl.[2] ..... A41D 13/00

[52] U.S. Cl. ..... 2/2; 2/69; 2/79; 2/81; 2/DIG. 1; 428/178

[58] Field of Search ..... 2/2, 69, 79, 81, 82, 2/DIG. 1, 2.1 R, 2.1 A; 428/178

[56] References Cited

U.S. PATENT DOCUMENTS

| | | | |
|---|---|---|---|
| 2,543,317 | 2/1951 | Hammond | 2/DIG. 1 |
| 3,045,243 | 7/1962 | Lash et al. | 2/DIG. 1 |
| 3,636,566 | 1/1972 | Sutherland | 2/69.5 |
| 3,739,399 | 6/1973 | Sheahon | 2/69.5 |
| 3,761,962 | 10/1973 | Myers | 2/79 |
| 3,863,343 | 2/1975 | Malmir | 2/2 X |

FOREIGN PATENT DOCUMENTS

| | | | |
|---|---|---|---|
| 1199486 | 6/1959 | France | 2/DIG. 1 |

*Primary Examiner*—H. Hampton Hunter
*Attorney, Agent, or Firm*—Daniel Jay Tick

[57] ABSTRACT

An insulating material consists of moldable material and a plurality of spherical air pockets formed in the material.

5 Claims, 9 Drawing Figures

VENTILATING AND INSULATING GARMENT

BACKGROUND OF THE INVENTION

The present invention relates to an insulating material and garment made of such material.

Material and garments similar to the material and garment disclosed herein are described in U.S. Pat. Nos. 3,818,507; 3,867,236; 3,921,944; 3,984,142 and 3,995,320.

Objects of the invention are to provide an insulating material of simple structure, which is inexpensive in manufacture, and functions efficiently, effectively and reliably to permit air circulation therethrough thereby providing a cooling and heating function for a person wearing the material in the form of a garment, and protecting a wearer of a garment of such material from injury due to accident or contact with objects or other people, in work or sport.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figures 1, 2, 3, 4, 5, 6, 7, 8, 9:
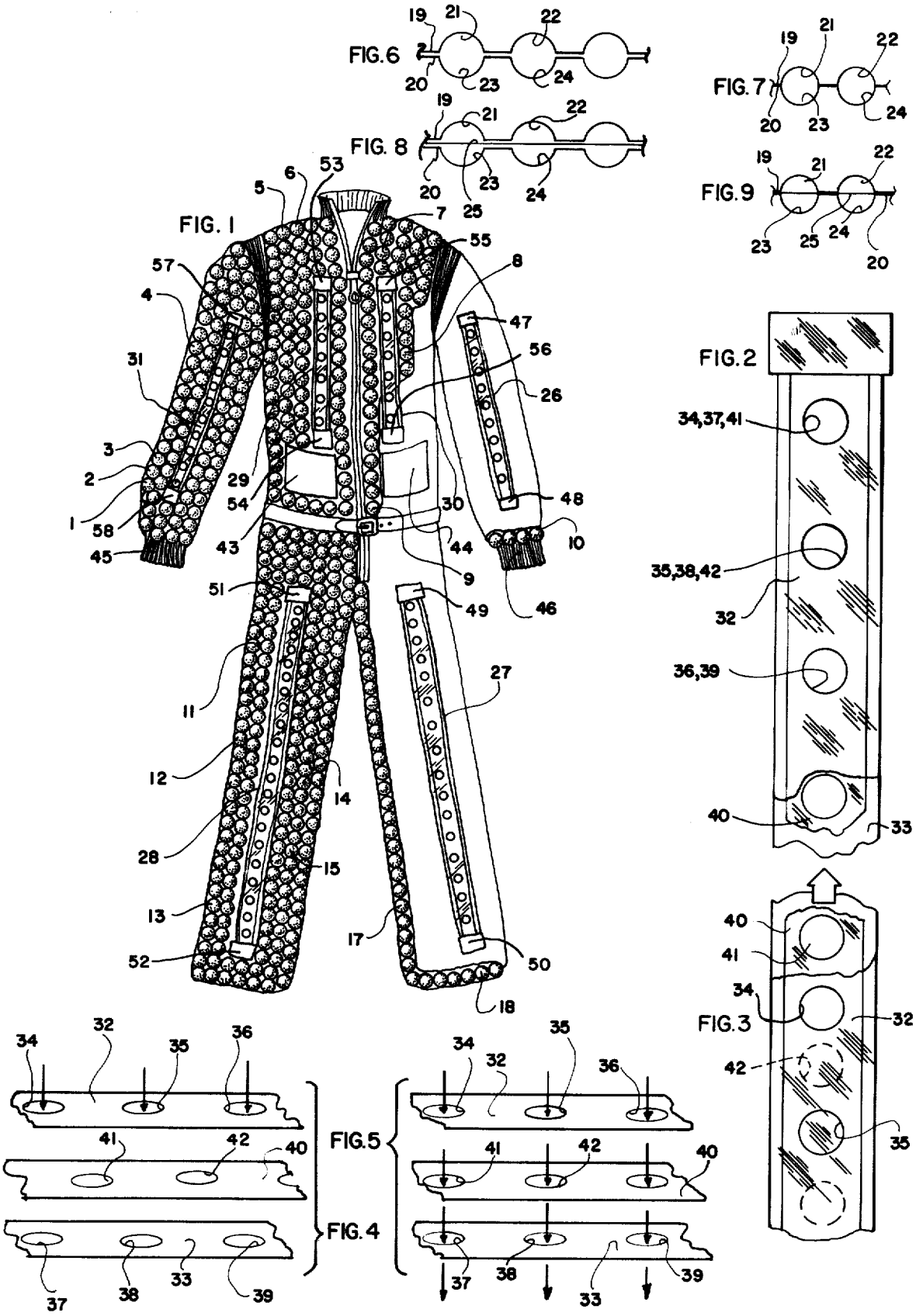
FIG. 1 is a view of an embodiment of a garment made of the insulating material of the invention.
FIG. 2 is a view, on an enlarged scale, of an embodiment of a ventilating device of the garment of FIG. 1, in open position.
FIG. 3 is a view, on an enlarged scale, of the embodiment of FIG. 2, in closed position.
FIG. 4 is an exploded perspective view, on an enlarged scale, illustrating the positions of the components of the ventilating device of the invention in closed position.
FIG. 5 is an exploded perspective view, on an enlarged scale, of the ventilating device of the invention in open position.
FIG. 6 is a schematic diagram illustrating one method of forming the pockets of the insulating material of the invention.
FIG. 7 is a schematic diagram illustrating the completed pockets formed by the method of FIG. 6.
FIG. 8 is a schematic diagram illustrating another method of forming the pockets of the insulating material of the invention.
FIG. 9 is a schematic diagram of the completed pockets formed by the method of FIG. 8.

The insulating material of the invention comprises moldable material of any suitable type such as, for example, plastic or rubber material. In accordance with the invention, a plurality of substantially spherical air pockets 1, 2, 3, 4, 5, 6, 7, 8, 9, 10, 11, 12, 13, 14, 15, 16, 17, 18, and so on, are formed in the material, as shown in FIG. 1.

FIG. 1 illustrates a garment made of the insulating material of the invention. The garment of FIG. 1 is in the nature of coveralls, but may, of course, be formed as any desirable outer or inner garment such as, for example, a blouse or shirt, pants, a vest, or the like.

The air pockets of the material may be formed in a single layer of material, or they may be formed in two layers of material, in which case the moldable material consists of two layers 19 and 20, shown in FIGS. 6 to 9. Each layer of material 19 and 20 has a plurality of substantially semispherical air pockets formed therein.

Thus, as shown in FIGS. 6 to 9, the layer of material 19 has air pockets 21, 22, and so on, formed therein. The layer of material 20 has a plurality of air pockets 23, 24, and so on, formed therein (FIGS. 6 to 9). The layers of material 18 and 20 are airtightly sealed together, as shown in FIGS. 7 and 9, in a manner whereby the semispherical air pockets are combined to form spherical air pockets.

In the embodiment of FIGS. 8 and 9, a third layer of material 25 is interposed, and sealed between, the two layers of material 19 and 20.

When the insulating material of the invention is utilized to make a garment, the outer surface of the garment is preferably coated with a luminous coating or material of any suitable type. This protects the wearer of the garment at night where there are vehicles present, since the lights of the vehicles readily illuminate the luminous surface of the garment.

A plurality of elongated holes 26, 27, 28, 29, 30 and 31 are formed through the garment of FIG. 1 and, in accordance with the invention, ventilating devices are movably mounted in the garment and manually positioned to selectively cover and uncover the holes 26 to 31. The structure and operation of a ventilating device of the garment are illustrated in FIGS. 2 to 5.

A ventilating device of the garment of the invention comprises first and second strips 32 and 33 of any suitable material, such as, for example, plastic, affixed in a hole 26 to 31 in substantially juxtaposed position in the manner shown in FIG. 2. Each of the first and second strips of material 32 and 33 has a plurality of spaced holes formed therethrough. Thus, the strip 32 has a plurality of spaced holes 34, 35, 36, and so on, formed therethrough, as shown in FIGS. 2 to 5, and the strip of material 33 has a plurality of spaced holes 37, 38, 39, and so on, formed therethrough, as shown in FIGS. 2 to 5. The holes of the first and second strips of material are of equal dimensions and are equidistantly spaced from each other so that the holes of the first strip of material are in alignment with the holes of the second strip of material. A third strip of material 40 of any suitable type such as, for example, plastic, is slidaly interposed between the first and second strips of material 32 and 33, as shown in FIGS. 2 to 5, and has a plurality of spaced holes 41, 42, and so on, formed therethrough, as shown in FIGS. 2 to 5.

The third strip 40 is manually movable to selectively clear and block the holes of the first and second strips 32 and 33. Thus, in one position of the third strip 40, shown in FIGS. 2 and 5, the holes of all three strips are in alignment, and the ventilating device is open, thereby permitting a flow of air into the garment. In another position of the third strip 40, shown in FIGS. 3 and 4, the holes of said third strip are spaced between the holes of the first and second strips 32 and 33, so that the ventilating device is closed, thereby preventing a flow of air into the garment.

The third strip 40 of each of the ventilating devices of the garment is manually movable to selectively position said strip to alignment or non-alignment holes of all three strips of said devices. This is accomplished by manual gripping and pulling of pull tabs extending from the spaced opposite ends of each of the third strips 40, as shown in FIG. 1. Thus, as shown in FIG. 1, the third strips of the ventilating devices of the holes 26 to 31, respectively, have pull tabs 47 and 48, 49 and 50, 51 and 52, 53 and 54, 55 and 56, and 57 and 58, respectively.

When the third strip 40 is manually positioned so that the holes of all three strips are in alignment and the ventilating device is open, as shown in FIG. 5, the garment and the person wearing such garment are cooled. When the third strip 40 is manually positioned so that the holes of the third strip are spaced from the holes of the first and second strips 32 and 33, so that the ventilating device is closed, as shown in FIG. 4, the garment is also closed and the person wearing such garment is warmed or heated.

The air pockets are preferably approximately one inch in diameter and preferably approximately 2000 air pockets are provided in a single garment. The air pockets of the garment provide the thermal insulation and the ventilating devices of the garment permit air cooling of the garment in the event that the user becomes overheated.

The garment of the invention is suitable for use by cyclists, football players, mechanics, miners, and the like, since its air pockets protect the user from injury due to impact with other objects and the luminous coating on its outer surface make it readily visible under all conditions. The garment preferably has pockets 43 and 44 (FIG. 1) and wrist cuffs 45 and 46 (FIG. 1).

While the invention has been described by means of a specific example and in a specific embodiment, I do not wish to be limited thereto, for obvious modifications will occur to those skilled in the art without departing from the spirit and scope of the invention.

I claim:

1. A garment, comprising insulating material dimensioned and shaped to fit on a human body, said insulating material consisting of moldable material having a plurality of substantially spherical air pockets formed in the material;

an elongated hole formed through the insulating material; and ventilating means movably mounted in said insulating material and manually positioned to selectively cover and uncover said hole, said ventilating means including manual means for manually moving said ventilating means to selectively cover and uncover said hole, last line, before the period has been inserted—said ventilating means comprising first and second strips affixed in the hole in substantially juxaposed position each of said first and second strips having a plurality of spaced holes formed therethrough, the holes of said first and second strips being in alignment, and a third strip slidably interposed between the first and second strips and having a plurality of sp spaced holes formed therethrough, said third strip including said manual means and being manually movable to selectively clear and block the holes of said first and second strips.

2. A garment as claimed in claim 1, wherein the insulating material consists of two layers of material each having a plurality of substantially semispherical air pockets formed therein, said layers being airtightly sealed together in a manner whereby the semispherical air pockets are combined to form spherical air pockets.

3. A garment as claimed in claim 1, wherein the insulating material consists of one of plastic and rubber material.

4. A garment as claimed in claim 1, wherein the insulating material has an outer surface, and further comprising a luminous coating on said outer surface.

5. A garment as claimed in claim 2, further comprising a third layer of material interposed and sealed between the two layers of material.

* * * * *